US005828182A

United States Patent [19]

Shannon et al.

[11] Patent Number: 5,828,182

[45] Date of Patent: Oct. 27, 1998

[54] APPARATUS FOR SUPPLYING POWER FROM A BALLAST CIRCUIT TO AN AUXILIARY LOAD

[75] Inventors: John R. Shannon, Daly City; Jeffrey Michael Dixon, Freemont; Hubertus Notohamiprodjo, Union City, all of Calif.

[73] Assignee: Electronic Lighting Incorporated, Menlo Park, Calif.

[21] Appl. No.: 636,647

[22] Filed: Apr. 23, 1996

[51] Int. Cl.[6] ..... H05B 37/00

[52] U.S. Cl. ..... 315/171; 315/158; 315/272; 315/276; 323/311

[58] Field of Search ..... 315/246, 200 R, 315/283, 244, 205, 208, 276, 272, 261, 171, 158; 323/222, 311

[56] References Cited

U.S. PATENT DOCUMENTS 4,300,090 11/1981 Weber ..... 323/311
4,672,300 6/1987 Harper ..... 323/222
5,039,914 8/1991 Szuba ..... 315/158
5,130,613 7/1992 Szuba ..... 315/291

*Primary Examiner*—Robert J. Pascal
*Assistant Examiner*—Haissa Philogene
*Attorney, Agent, or Firm*—Burns, Doane, Swecker & Mathis, L.L.P.

[57] ABSTRACT

The present invention is directed to a power supply circuit for controlling a load which, for example, includes both a gas-discharge lamp and an auxiliary load. The power supply circuit includes a ballast circuit for limiting current supplied to the gas discharge lamp. The auxiliary load, such as an occupancy sensor, is connected to receive an alternating current signal from a transformer winding, inductor coil, or other suitable portion of the ballast circuit. The power supply circuit includes a rectifier for rectifying the alternating current signal to provide a stable, low-voltage direct current signal to drive the auxiliary load.

12 Claims, 1 Drawing Sheet

APPARATUS FOR SUPPLYING POWER FROM A BALLAST CIRCUIT TO AN AUXILIARY LOAD

BACKGROUND OF THE INVENTION

1. Field of the Invention

The present invention relates generally to power supplies. More particularly, the present invention relates to an apparatus for supplying power to a negative resistance load which includes an additional auxiliary load.

2. State of the Art

To control the current drawn by a load, a variety of AC power control circuits have been developed. Typical AC power control circuits seek to ensure that the load draws a current which is substantially sinusoidal and in phase with an AC supply voltage. Such circuits have a wide variety of applications, including their use with a dimming ballast to control a gas-discharge lamp.

Gas-discharge lamps generate light when an electric current passes through the gas contained within the lamp. Gas-discharge lamps have a negative resistance (that is, a resistance which decreases as the current increases), and are typically provided with a power control circuit for maintaining AC current supplied to the lamp substantially sinusoidal and in phase with the AC supply voltage. As is known in the art, a high-frequency current generates light more efficiently than the 60 Hz frequency of a standard AC supply voltage.

It is known to use devices, such as photo sensors or slide dimmers, in conjunction with a lamp to regulate light output from the lamp. However, these devices are variable resistance devices which are not continuously driven by a power supply, but rather respond to some external influence to produce a change in resistance for regulating lamp output. In other words, these devices do not require a continuous, stable power supply to provide their intended function. Further, such devices are typically connected with a dimming interface of the ballast circuit which is unstable and which does not provide a large current. These devices must therefore be low-current devices.

In addition to the devices described above, conventional lighting control systems frequently include an occupancy sensor to detect the presence of a person in a room or area, and thus the necessity of initiating or maintaining operation of a lamp. However, auxiliary devices, such as occupancy sensors, require a stable current of higher magnitude than that associated with the devices described above, and therefore are provided with a separate power source. Because the dimming interface is unstable, it is unsuitable for driving auxiliary loads, such as occupancy sensors, which are used in conjunction with a lamp control system and which must be actively driven by a power supply. This requirement for a separate power supply limits the potential locations of the occupancy sensor due, for example, to the size of the power supply. Auxiliary devices having a separate power supply also require complex installation which involves having an electrician connect the auxiliary device with the ballast.

It would therefore be desirable to provide a power supply capable of supplying stable, low-voltage direct current sufficient to drive an auxiliary device, such as an occupancy sensor, such that auxiliary functions can be easily implemented without the need for an electrician.

SUMMARY OF THE INVENTION

The present invention is directed to a power supply circuit for controlling a load which, for example, includes both a gas-discharge lamp and an auxiliary load. The power supply circuit includes a ballast circuit for limiting current supplied to the gas discharge lamp. The auxiliary load, such as an occupancy sensor, is connected to receive an alternating current signal from a transformer winding, inductor coil, or other suitable portion of the ballast circuit. The power supply circuit includes a rectifier for rectifying the alternating current signal to provide a stable, low-voltage direct current signal to drive the auxiliary load.

According to one embodiment of the invention, the power supply circuit includes means, such as a circuit, for limiting current supplied to a negative resistance load. The current limiting means includes a first alternating current supply portion. The power supply circuit further includes means, such as a second current supply portion, for receiving an alternating current from the first alternating current supply portion and supplying a direct current to an auxiliary load.

By supplying a stable low-voltage direct current signal from the ballast, it is possible to actively drive many types of auxiliary devices such as occupancy sensors, infra-red or radio frequency (RF) remote control receivers, control devices for prioritizing local and global lighting control signals, and other relatively high current devices which could not previously be driven without the use of a separate dedicated power supply.

BRIEF DESCRIPTION OF THE DRAWINGS

The present invention can be further understood with reference to the following description and the appended drawings, wherein like elements are provided with the same reference numerals. In the drawings.

DETAILED DESCRIPTION OF THE PREFERRED EMBODIMENTS

Figure 1:
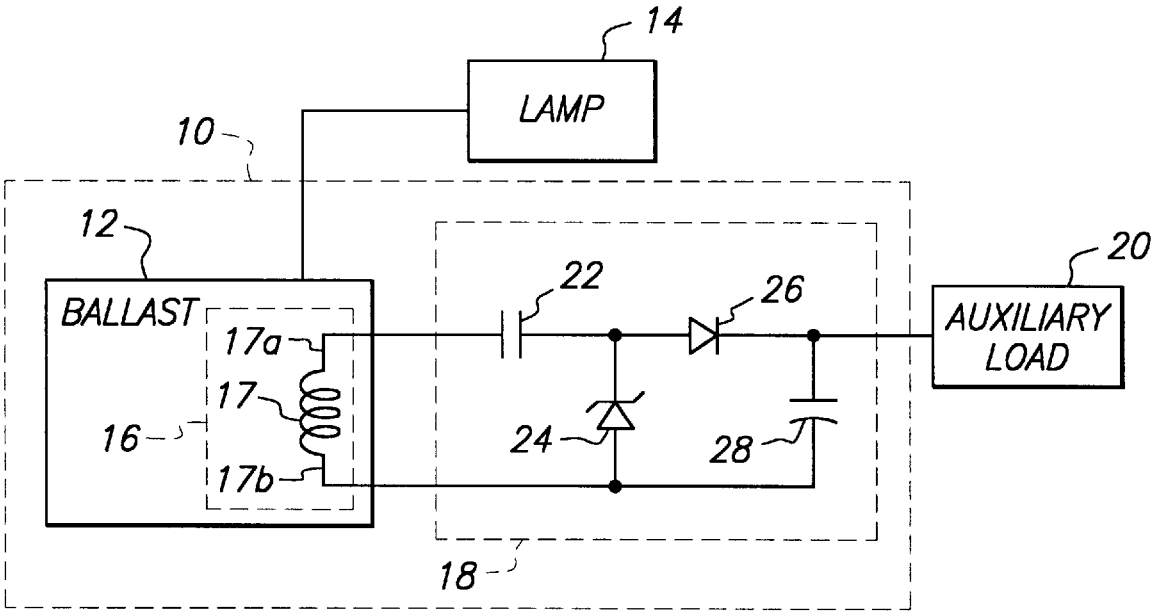
FIG. 1 is a schematic diagram of a power supply circuit according to one embodiment of the present invention.

Referring to FIG. 1, a schematic diagram of a power supply circuit according to an exemplary embodiment of the present invention is shown. The power supply circuit 10 includes a ballast circuit 12 for controlling the current supplied to a lamp 14. The ballast circuit 12 is a conventional ballast circuit which includes a first supply portion 16 suitable for supplying a stable AC voltage signal. In the embodiment shown in FIG. 1, the first supply portion 16 includes an inductor coil 17 in the output electromagnetic structure of the ballast circuit. The inductor coil 17 could alternately be a section of a transformer winding of the output electromagnetic structure, or other portion capable of supplying a relatively stable AC signal, suitable for driving the desired auxiliary device. The coil 17 can be any winding which is electrically isolated from the ballast input power supply and from the lamp winding.

The circuit 10 also includes a second supply portion 18 for supplying power to an auxiliary load 20. The second supply portion 18 is connected between first and second connection points 17*a*, 17*b* of the supply portion 16 and the auxiliary load 20. The second supply portion 18 rectifies the high-frequency alternating current signal received from the coil of the first supply portion to provide a low-voltage direct current signal to the auxiliary load 20.

It will be appreciated that first capacitance 22 provides a limiting impedance for short-circuit currents, and as a result, the second supply portion is not susceptible to short-circuit. That is, if a short-circuit or fault occurs in the second supply portion or in the auxiliary load, the ballast remains operational. Further, a network of lamp ballasts can be connected in parallel, such that failure of one lamp ballast, and therefore its associated power circuit, does not affect the operation of the remaining lamp ballasts and auxiliary circuits.

The second supply portion 18 includes a first capacitance 22 connected at a first terminal to first connection point 17*a* of the first supply portion 16. A zener diode 24 is connected in series between second connection point 17*b* of the first supply portion 16 and a second terminal of first capacitance 22. A diode 26 is connected in a forward-conducting direction, in series between the second terminal of first capacitance 22 and an input to the auxiliary load 20. Finally, a second capacitance 28 is connected between the second connection point 17*b* of supply portion 16 and the input to auxiliary load 20.

In operation, the zener diode 24 and diode 26 rectify the high-frequency alternating current signal from the first supply portion 16. Specifically, when the voltage differential between first connection point 17*a* and second connection point 17*b* is positive, current flows through first capacitance 22 and diode 26 into auxiliary load 20 and into second capacitance 28. This current flow causes charge to be stored in first capacitance 22 and in second capacitance 28. When the voltage differential between first connection point 17*a* and second connection point 17*b* is negative, the current flow reverses. The charge stored in second capacitance 28 is discharged to supply a direct current signal to the input of auxiliary load 20. The charge on first capacitance 22 is also discharged during this time. Zener diode 24 regulates the voltage supplied to the auxiliary load 20. It will be appreciated that the second supply portion 18 can include a rectifier circuit for rectifying the AC input signal to generate a DC output signal. Other suitable components and rectifier arrangements readily apparent to those skilled in the art can, of course, be used to provide a desired power input to auxiliary load 20.

According to an exemplary embodiment of the present invention, first capacitance 22 is a 0.015 microfarad capacitor rated for 100 volts, and second capacitance 28 is a 22 microfarad capacitor rated for 50 volts. Zener diode 24 is a 1N4743A zener diode, and diode 26 is a 1N4148 diode. It will be appreciated that alternate values can be used to provide a desired power input to a particular auxiliary device 20. The high-frequency AC signal received from first supply portion 16 is in an exemplary embodiment, approximately 15 volts AC at approximately 38–50 kHz, and the output signal supplied to the auxiliary load 20 is approximately 12 volts and approximately 20 mA. It will be appreciated that other output values can be provided depending upon the auxiliary load to be driven.

Auxiliary load 20 can be an occupancy sensor for determining motion in a room or other area to be illuminated. Alternately, auxiliary load 20 can be a remote control receiver for receiving a wireless control signal, such as an infrared or RF remote control signal, to control lamp operation. Auxiliary load 20 can also be a processor or other control device capable of receiving, prioritizing, and executing control signals received from, for example, a local control signal source used to control an individual lamp or small group of lamps and/or a global control signal source used to control a large collection of lamps. It will be appreciated that many other auxiliary loads can be driven by the power supply circuit of the present invention.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A power supply for supplying power to a negative resistance load, comprising:

a circuit for limiting current supplied to the negative resistance load, the circuit including a first alternating current supply portion; and a second supply portion for receiving an alternating current from the first alternating current supply portion and supplying a direct current to an auxiliary load, the second supply portion being electrically isolated from the first alternating current supply portion.

2. The power supply circuit of claim 1, wherein the load is a gas-discharge lamp and the auxiliary load is an occupancy sensor.

3. The power supply circuit of claim 1, wherein the second supply portion further includes:

a first capacitance having a first terminal connected to the first alternating current supply portion;

a zener diode connected in series between the first alternating current supply portion and a second terminal of the first capacitance;

a diode connected in series between the second terminal and an input to the auxiliary load; and a second capacitance connected between supply portion and the input to the auxiliary load.

4. The power supply circuit of claim 1, wherein the second supply portion is a rectifier for rectifying the alternating current to generate the direct current.

5. The power supply circuit of claim 3, wherein the first capacitance is approximately 0.015 microfarads.

6. The power supply circuit of claim 3, wherein the zener diode is a 1N4743A zener diode.

7. The power supply circuit of claim 3, wherein the diode is a 1N4148 diode.

8. The power supply circuit of claim 3, wherein the second capacitance is approximately 22 microfarads.

9. The power supply circuit of claim 1, wherein the direct current is a direct current signal of approximately 12 volts.

10. The power supply circuit of claim 1, wherein the direct current is a direct current signal of approximately 20 milliamps.

11. The power supply circuit of claim 1, wherein the auxiliary load is a receiver for receiving a wireless control signal.

12. A power supply circuit for supplying power to a negative resistance load, comprising:

means for limiting current supplied to the negative resistance load, the current limiting means including a first alternating current supply portion; and electrically isolated means for receiving an alternating current from the first alternating current supply portion and supplying a direct current to an auxiliary load.

* * * * *